US011147742B1

(12) United States Patent
Omokhodion

(10) Patent No.: US 11,147,742 B1
(45) Date of Patent: Oct. 19, 2021

(54) TIMED MEDICANT DISPENSING DEVICE

(71) Applicant: Omokhuale Omokhodion, Smyrna, GA (US)

(72) Inventor: Omokhuale Omokhodion, Smyrna, GA (US)

( * ) Notice: Subject to any disclaimer, the term of this patent is extended or adjusted under 35 U.S.C. 154(b) by 0 days.

(21) Appl. No.: 16/936,590

(22) Filed: Jul. 23, 2020

(51) Int. Cl.
*A61J 7/04* (2006.01)
*A61J 7/00* (2006.01)
*B65D 83/04* (2006.01)

(52) U.S. Cl.
CPC ..... *A61J 7/0481* (2013.01); *A61J 7/0076* (2013.01); *B65D 83/0454* (2013.01)

(58) Field of Classification Search
CPC ..... A61J 7/0481
See application file for complete search history.

(56) References Cited

U.S. PATENT DOCUMENTS 4,572,403 A * 2/1986 Benaroya ..... A61J 7/04 221/15
5,603,429 A 2/1997 Mulhauser
6,145,697 A 11/2000 Gudish
6,427,865 B1 8/2002 Stillwell
6,574,165 B2 6/2003 Sharma
D604,835 S 11/2009 Conley
7,896,192 B2 3/2011 Conley
9,492,357 B2 11/2016 MacVittie
2012/0316405 A1 12/2012 Taylor

FOREIGN PATENT DOCUMENTS

WO WO2015157759 10/2015

* cited by examiner

*Primary Examiner* — Gene O Crawford
*Assistant Examiner* — Ayodeji T Ojofeitimi

(57) ABSTRACT

A timed medicant dispensing device for limiting abuse of controlled substances includes a shell, which is selectively securable to the disc so that the shell and the disc define an interior space. The shell has an aperture positioned therein proximate to a perimeter thereof. A ring positioned in the interior space has a plurality of slats engaged thereto and extending outwardly therefrom to define a plurality of compartments. Each compartment is configured to have positioned therein a respective medicant. A rotator engaged to the disc and operationally engaged to the ring is positioned to selectively rotate the ring to align a respective compartment with the aperture. A timer engaged to the disc and operationally engaged to the rotator is positioned to selectively actuate the rotator to rotate the ring to align the respective compartment with the aperture. The aperture is configured to allow dispensing of the respective medicant.

11 Claims, 5 Drawing Sheets

TIMED MEDICANT DISPENSING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dispensing devices and more particularly pertains to a new dispensing device for limiting abuse of controlled substances.

(2) Description of Related Art Including Information Disclosed Under 37 CFR 1.97 and 1.98

The prior art relates to dispensing devices. Prior art dispensing device for medicants may comprise gears, motors, timers, and locks.

BRIEF SUMMARY OF THE INVENTION

An embodiment of the disclosure meets the needs presented above by generally comprising a shell, which is selectively securable to a disc so that the shell and the disc define an interior space. The shell has an aperture positioned therein proximate to a perimeter thereof. A ring is positioned in the interior space and has a plurality of slats engaged to and extending outwardly therefrom to proximate to a sidewall of the shell to define a plurality of compartments. Each compartment is configured to have positioned therein a respective medicant.

A rotator is engaged to the disc and is operationally engaged to the ring. The rotator is positioned to selectively rotate the ring to align a respective compartment with the aperture. A timer is engaged to the disc and is operationally engaged to the rotator. The timer is positioned to selectively actuate the rotator to rotate the ring to align the respective compartment with the aperture. The aperture is configured to allow dispensing of the respective medicant.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
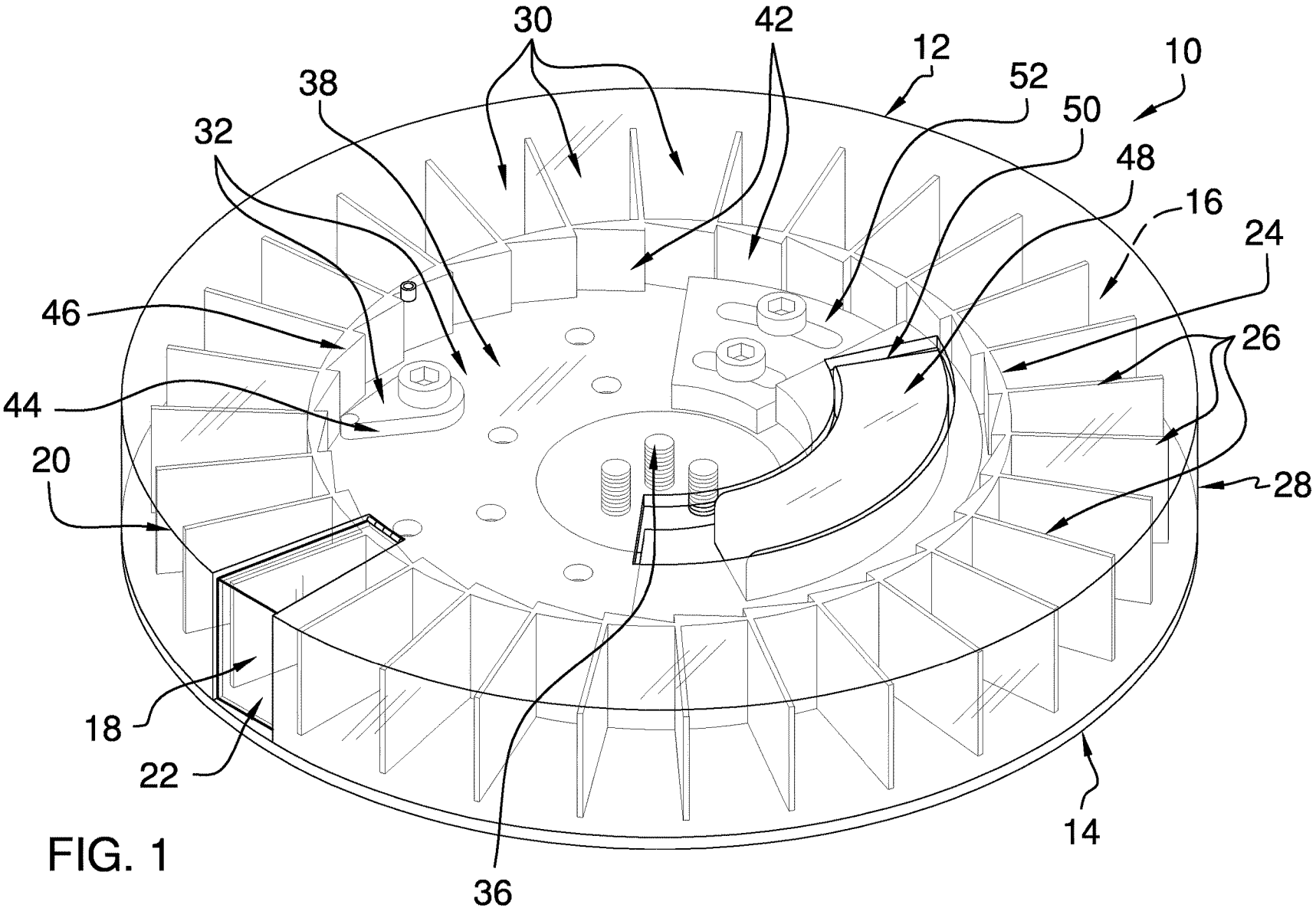
FIG. 1 is an isometric perspective view of a timed medicant dispensing device according to an embodiment of the disclosure.
Figure 2:
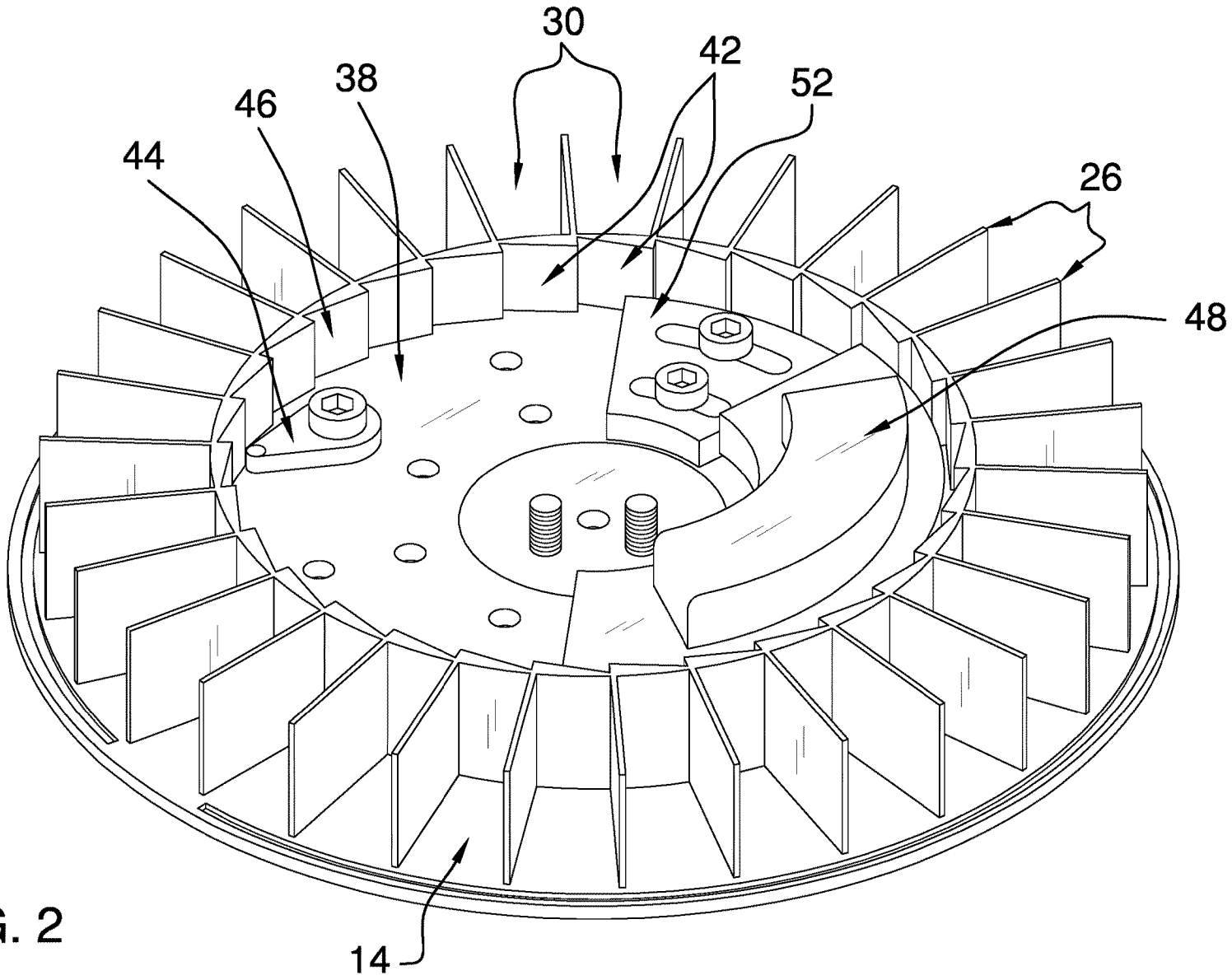
FIG. 2 is an isometric perspective view of an embodiment of the disclosure having the shell removed.

With reference now to the drawings, and in particular to FIGS. 1 through 6 thereof, a new dispensing device embodying the principles and concepts of an embodiment of the disclosure and generally designated by the reference numeral 10 will be described.

Figure 6:
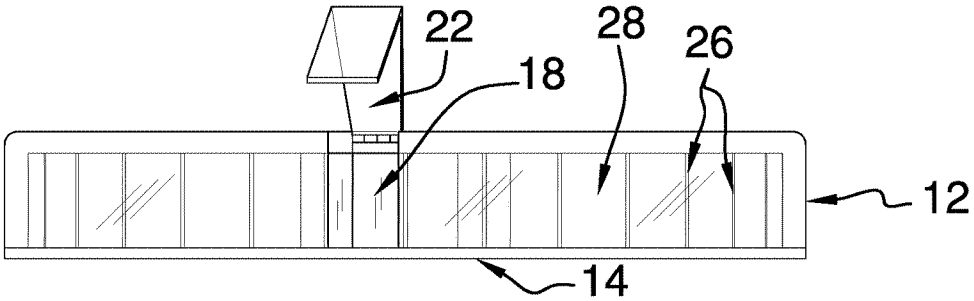
FIG. 6 is a side view of an embodiment of the disclosure.

As best illustrated in FIGS. 1 through 6, the timed medicant dispensing device 10 generally comprises a shell 12, which is selectively securable to a disc 14 so that the shell 12 and the disc 14 define an interior space 16. The shell 12 has an aperture 18 positioned therein proximate to a perimeter 20 thereof. A panel 22 is hingedly engaged to one of the shell 12 and the disc 14 and is configured to selectively close the aperture 18. For example, the panel 22 may be hingedly engaged to the shell 12, as shown in FIGS. 1 and 6, wherein the panel 22 is depicted in closed and open configurations, respectively. The present invention also anticipates the panel 22 being slidable engaged to one of the shell 12 and panel 22.

Figure 3:
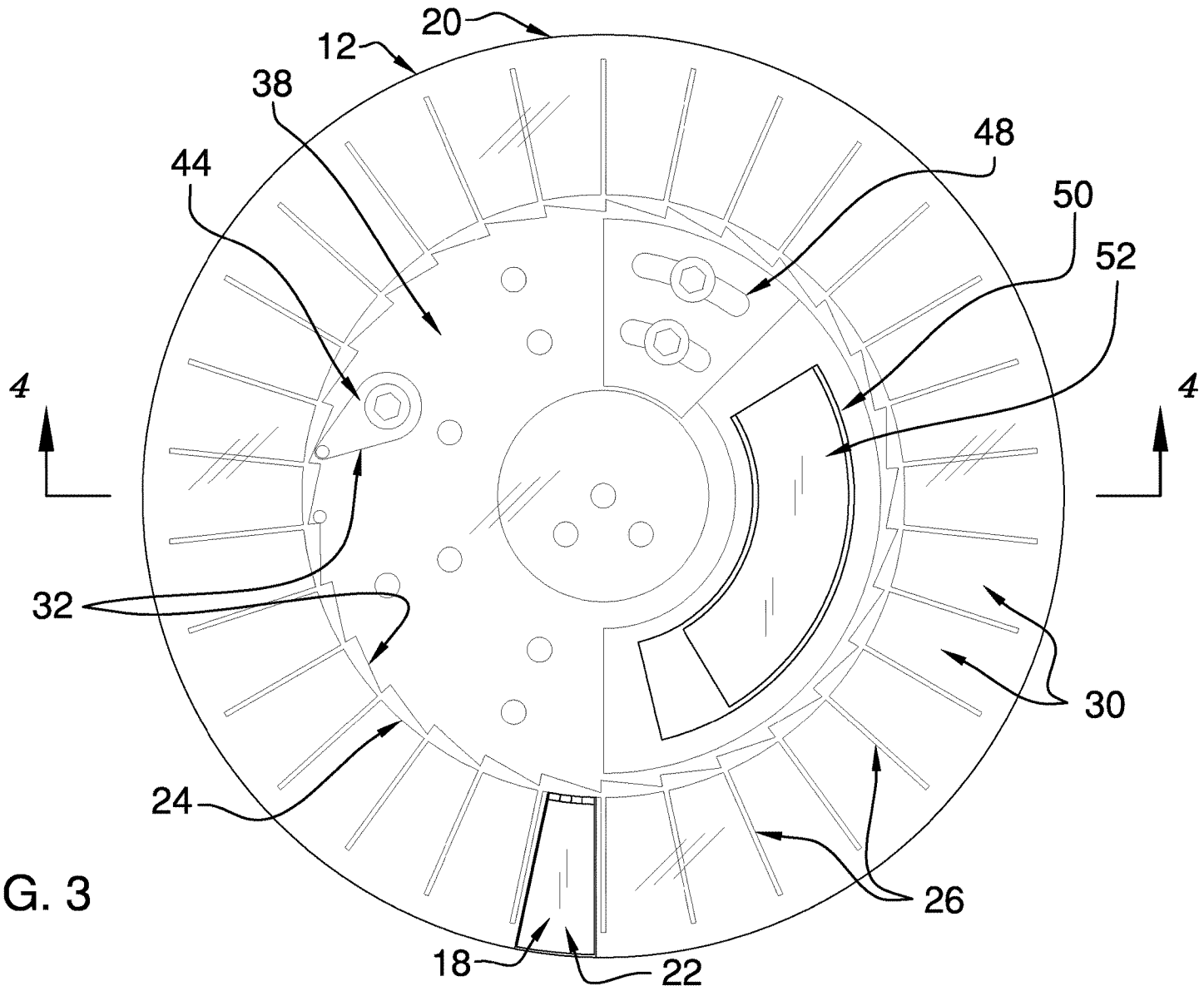
FIG. 3 is a top view of an embodiment of the disclosure.
Figure 4:
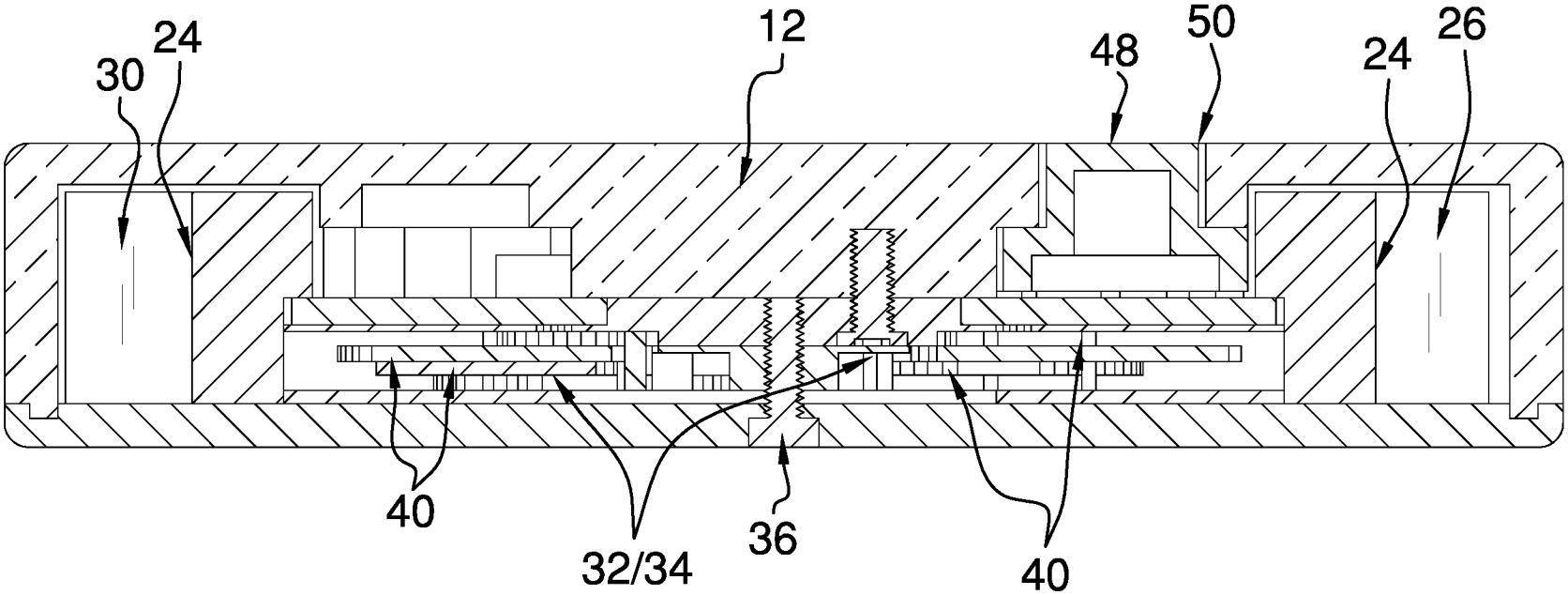
FIG. 4 is a cross-sectional view of an embodiment of the disclosure.
Figure 5:
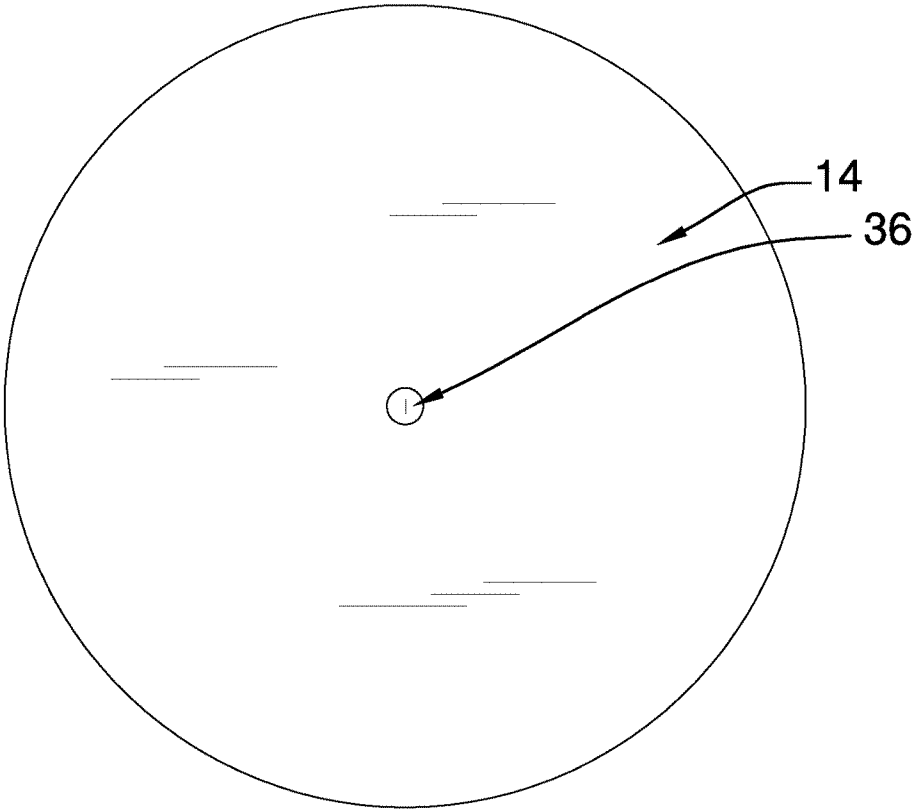
FIG. 5 is a bottom view of an embodiment of the disclosure.

A ring 24 is positioned in the interior space 16 and has a plurality of slats 26 engaged thereto and extending outwardly therefrom to proximate to a sidewall 28 of the shell 12 to define a plurality of compartments 30. Each compartment 30 is configured to have positioned therein a respective medicant, such as an opioid. The plurality of compartments 30 comprises from seven to ninety compartments 30. The plurality of compartments 30 may comprise from fourteen to thirty one compartments 30. The plurality of compartments 30 may comprise thirty compartments 30, as shown in FIG. 3.

A rotator 32 is engaged to the disc 14 and is operationally engaged to the ring 24. The rotator 32 is positioned to selectively rotate the ring 24 to align a respective compartment 30 with the aperture 18. A timer 34 is engaged to the disc 14 and is operationally engaged to the rotator 32. The timer 34 is positioned to selectively actuate the rotator 32 to rotate the ring 24 to align the respective compartment 30 with the aperture 18 so that the aperture 18 is configured to allow dispensing of the respective medicant. The timer 34 is configured to effect a dispensing cycle, which may comprise two hours, four hours, six hours, eight hours, twelve hours, or twenty four hours.

A bolt 36 is positioned axially through the disc 14. The bolt 36 is selectively engageable to the shell 12 to secure the shell 12 to the disc 14. The bolt 36 is configured to be locked and thus is configured to deter unauthorized access to the interior space 16. The device 10 is anticipated to be particularly useful in the dispensing of controlled substances, such as opioids. The bolt 36 being lockable permits a pharmacist to load the compartments 30 with prescribed doses of medicants and to lock the device 10 to prevent abuse. The automated dispensing also promotes timely dosing of the medicant.

The timer 34 and the rotator 32 together comprises a plate 38, a plurality of gears 40, a plurality of teeth 42, and a pawl 44. The plate 38 is rotationally engaged to the disc 14 and is spring-loaded. The gears 40 of the plurality of gears 40 are gearedly interconnected. The plurality of gears 40 is operationally engaged to the plate 38 so that the plurality of gears 40 is positioned to regulate rotation of the plate 38.

The plurality of teeth 42 is engaged to and extends inwardly from the ring 24 to define a ratchet 46. The pawl 44 is engaged to the plate 38 and is gearedly engaged to the plurality of teeth 42. The pawl 44 is positioned to selectively engage a respective tooth 42 to effect stepwise rotation of the ring 24. Each step of the stepwise rotation corresponds with a respective compartment 30 being brought into alignment with the aperture 18.

A bar 48 is engaged to the plate 38 and extends therefrom through an opening 50 in the shell 12. The bar 48 is configured to be slid within the opening 50 to tension the plate 38. A block 52 is engaged to the disc 14 and is positioned proximate to the bar 48 within the interior space 16. The block 52 is positioned to limit sliding of the bar 48 within the opening 50.

In use, the pharmacist adds the prescribed medicant to the compartments 30 and then secures the shell 12 to the disc 14 using the bolt 36. The timer 34 actuates the rotator 32 at a prescribed interval so that the ring 24 rotates to align a compartment 30 with the aperture 18. A user can then retrieve the medicant from the compartment 30 by tilting or inverting the device so that the medicant falls from the compartment 30 through the aperture 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A timed medicant dispensing device comprising:

a disc;

a shell selectively securable to the disc such that the shell and the disc define an interior space, the shell having an aperture positioned therein proximate to a perimeter thereof;

a ring positioned in the interior space;

a plurality of slats engaged to and extending outwardly from the ring to proximate to a sidewall of the shell defining a plurality of compartments, wherein each compartment is configured for positioning a respective medicant;

a rotator engaged to the disc and operationally engaged to the ring, such that the rotator is positioned for selectively rotating the ring fir aligning a respective compartment with the aperture;

a timer engaged to the disc and operationally engaged to the rotator, such that the timer is positioned for selectively actuating the rotator for rotating the ring for aligning the respective compartment with the aperture, wherein the aperture is configured for dispensing of the respective medicant; and wherein the timer and the rotator together comprise a plate rotationally engaged to the disc, the plate being spring-loaded, a plurality of gears, the gears of the plurality of gears being gearedly interconnected, the plurality of gears being operationally engaged to the plate, such that the plurality of gears is positioned for regulating rotation of the plate, a plurality of teeth engaged to and extending inwardly from the ring defining a ratchet, and a pawl engaged to the plate and being gearedly engaged to the plurality of teeth, such that the pawl is positioned for selectively engaging a respective tooth for effecting stepwise rotation of the ring.

2. The timed medicant dispensing device of claim 1, further including a panel hingedly engaged to one of the shell and the disc and being configured for selectively closing the aperture.

3. The timed medicant dispensing device of claim 1, further including a bolt positioned axially through the disc, the bolt being selectively engageable to the shell for securing the shell to the disc, the bolt being configured for locking, wherein the bolt is configured for deterring unauthorized access to the interior space.

4. The timed medicant dispensing device of claim 1, wherein the plurality of compartments comprises from seven to ninety compartments.

5. The timed medicant dispensing device of claim 4, wherein the plurality of compartments comprises from fourteen to thirty one compartments.

6. The timed medicant dispensing device of claim 5, wherein the plurality of compartments comprises thirty compartments.

7. The timed medicant dispensing device of claim 1, wherein the timer is configured for effecting a dispensing cycle.

8. The timed medicant dispensing device of claim 7, wherein the dispensing cycle comprises two hours, four hours, six hours, eight hours, twelve hours, or twenty four hours.

9. The timed medicant dispensing device of claim further including a bar engaged to the plate and extending therefrom through an opening in the shell, wherein the bar is configured for sliding within the opening for tensioning the plate.

10. The timed medicant dispensing device of claim 9, further including a block engaged to the disc and positioned proximate to the bar within the interior space, such that the block is positioned for limiting sliding of the bar within the opening.

11. A timed medicant dispensing device comprising:

a disc;

a shell selectively securable to the disc such that the shell and the disc define an interior space, the shell having an aperture positioned therein proximate to a perimeter thereof;

a panel hingedly engaged to one of the shell and the disc and being configured for selectively closing the aperture;

a bolt positioned axially through the disc, the bolt being selectively engageable to the shell for securing the shell to the disc, the bolt being configured for locking, wherein the bolt is configured for deterring unauthorized access to the interior space;

a ring positioned in the interior space;

a plurality of slats engaged to and extending outwardly from the ring to proximate to a sidewall of the shell defining a plurality of compartments, wherein each compartment is configured for positioning a respective medicant, the plurality of compartments comprising from seven to ninety compartments, the plurality of compartments comprising from fourteen to thirty one compartments, the plurality of compartments comprising thirty compartments;

a rotator engaged to the disc and operationally engaged to the ring, such that the rotator is positioned for selectively rotating the ring for aligning a respective compartment with the aperture;

a timer engaged to the disc and operationally engaged to the rotator, such that the timer is positioned for selectively actuating the rotator for rotating the ring for aligning the respective compartment with the aperture, wherein the aperture is configured for dispensing of the respective medicant, the timer being configured for effecting a dispensing cycle, the dispensing cycle comprising two hours, four hours, six hours, eight hours, twelve hours, or twenty four hours, the timer and the rotator together comprising:

a plate rotationally engaged to the disc, the plate being spring-loaded, a plurality of gears, the gears of the plurality of gears being gearedly interconnected, the plurality of gears being operationally engaged to the plate, such that the plurality of gears is positioned for regulating rotation of the plate, a plurality of teeth engaged to and extending inwardly from the ring defining a ratchet, and a pawl engaged to the plate and being gearedly engaged to the plurality of teeth, such that the pawl is positioned for selectively engaging a respective tooth for effecting stepwise rotation of the ring;

a bar engaged to the plate and extending therefrom through an opening in the shell, wherein the bar is configured for sliding within the opening for tensioning the plate; and a block engaged to the disc and positioned proximate to the bar within the interior space, such that the block is positioned for limiting sliding of the bar within the opening.

* * * * *